US010666007B2

(12) United States Patent
Berkenbush et al.

(10) Patent No.: US 10,666,007 B2
(45) Date of Patent: May 26, 2020

(54) CABLE CONNECTOR TOOL

(71) Applicant: BAE Systems Information and Electronic Systems Integration Inc., Nashua, NH (US)

(72) Inventors: Richard E. Berkenbush, Pompton Plains, NJ (US); James W. Holley, Hackettstown, NJ (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 177 days.

(21) Appl. No.: 15/962,788

(22) Filed: Apr. 25, 2018

(65) Prior Publication Data

US 2019/0020165 A1 Jan. 17, 2019

Related U.S. Application Data

(60) Provisional application No. 62/489,603, filed on Apr. 25, 2017.

(51) Int. Cl.

| | |
|---|---|
| ***H01R 43/26*** | (2006.01) |
| ***B25G 1/00*** | (2006.01) |
| ***B25B 13/30*** | (2006.01) |
| ***B25B 13/06*** | (2006.01) |
| ***B25B 13/48*** | (2006.01) |
| ***B25B 23/142*** | (2006.01) |

(Continued)

(52) U.S. Cl.

CPC ..... *H01R 43/26* (2013.01); *B25B 13/06* (2013.01); *B25B 13/28* (2013.01); *B25B 13/30* (2013.01); *B25B 13/481* (2013.01); *B25B 13/5016* (2013.01); *B25B 23/142* (2013.01); *B25G 1/005* (2013.01)

(58) Field of Classification Search

CPC ... H01R 43/26; B25B 13/5016; B25B 13/481; B25B 13/06; B25B 13/28; B25B 13/30; B25B 13/5075; B25B 23/142

See application file for complete search history.

(56) References Cited

U.S. PATENT DOCUMENTS

| | | | |
|---|---|---|---|
| 1,521,464 | A | 12/1924 | Miller |
| 1,795,048 | A | 3/1931 | Schuh |

(Continued)

FOREIGN PATENT DOCUMENTS

| | | |
|---|---|---|
| GB | 2451859 | 2/2009 |
| WO | 2005030440 | 4/2005 |

OTHER PUBLICATIONS

U.S. Patent No. 986, 112, Mar. 7, 1911, James Wood. (Could not input into U.S. Patents section above).

(Continued)

*Primary Examiner* — David B. Thomas
(74) *Attorney, Agent, or Firm* — Scott J. Asmus

(57) ABSTRACT

A cable connector wrench and method of operation that in one example has a shaft with a pair of asymmetrical jaws at one end and a handle coupled to the other end. The two jaws form an assembly in which the jaws are joined with a pivot. The fixed jaw is attachable to the shaft and the movable jaw is coupled to the fixed jaw. The movable jaw and the fixed jaw cooperate to engage a connector of a cabled assembly wherein the connector wrench is adapted for tightening or loosening the connector of the cabled assembly.

16 Claims, 19 Drawing Sheets

(51) Int. Cl.
*B25B 13/50* (2006.01)
*B25B 13/28* (2006.01)

(56) References Cited

U.S. PATENT DOCUMENTS 2,166,449 A 7/1939 Sharpe
2,491,623 A 12/1949 Sesak
2,558,333 A 6/1951 Bachli et al.
2,819,637 A 1/1958 St. Pierre
2,936,661 A * 5/1960 Hostetter ..... B25B 23/1427 81/477
3,481,193 A * 12/1969 Schubert ..... B25B 23/142 73/862.21
4,485,702 A 12/1984 Swan et al.
5,146,813 A * 9/1992 Stanfill, Jr. ..... B25B 9/00 81/111
5,261,300 A * 11/1993 Willett ..... B25B 13/48 81/177.1
5,829,327 A 11/1998 Stanton
6,295,901 B1 * 10/2001 Mardirossian ..... B25B 13/48 81/119
6,339,980 B1 * 1/2002 Woolf ..... B25B 13/58 81/185
6,868,761 B2 * 3/2005 Stoick ..... B25B 13/50 81/120
6,883,403 B2 * 4/2005 Drewes ..... B25B 13/481 81/111
7,121,172 B1 10/2006 Daniels
7,171,875 B2 2/2007 Hu
9,969,062 B2 * 5/2018 Huang ..... B25B 13/28
10,160,102 B2 * 12/2018 Huang ..... B25B 13/28
2006/0207393 A1 9/2006 Stupar
2008/0168867 A1 7/2008 Recker
2014/0116206 A1 5/2014 Chartier et al.
2016/0107296 A1 4/2016 Marcelle et al.

OTHER PUBLICATIONS

Jaw Basin Wrench Attachment made by Superior Tool. Available for purchase at: https://www.lowes.ca/specialty-hand-tools/superior-tool-ratchet-jaw-basin-wrench-attachment_g1197508.html and http://www.superiortool.com/wrenches/basin.html.

* cited by examiner

CABLE CONNECTOR TOOL

CROSS-REFERENCE TO RELATED APPLICATIONS

This application claims the benefit of U.S Provisional Patent Application Ser. No. 62/489,603 filed Apr. 25, 2017 and is incorporated by reference in its entirety for all purposes.

STATEMENT OF GOVERNMENT INTEREST

This invention was made with government support under Contract No. N00039-15-D-0008 awarded by the United States Navy. The United States Government has certain rights in the invention.

FIELD OF THE DISCLOSURE

The following disclosure relates generally to a tool used for removal, tightening, or connection of terminals to an interface including those where access is limited.

BACKGROUND

When working with electronic and communication modules and interfaces that have limited access, connecting and removing of cabled connectors becomes difficult. Frequently there are multiple cables with stiff back-shells or other immovable obstructions that are in close proximity such that connecting and removing the cable connectors is difficult. In some cases all the cables need to be removed in order to gain sufficient access to the panel or to an individual cable. In other situations the cabled connection is positioned in a location that has limited access such that finger access is limited and the use of conventional connector pliers is ineffective.

Known cables include electrical, signal, data and cooling cables that are coupled to a module interface with the connectors typically located on a planar panel or other nearby surfaces. Electrical cables can route low and high voltage electrical power to accommodate the application requirements. Signal cables can be radio frequency (RF), microwave, analog, and digital signals. It is known that liquid cooling is often required; accordingly, a cooling fluid can also be routed via the interface. Cables include a connector with a mating connector on the interface panel.

It is known that connectors can be adjusted, such as tightened or loosened, by customized conventional tools. These customized tools can have angled sections or custom fit designs that are not universal and are adapted to specific constrained designs. Cable stiffness and certain back-shell types inhibit easy removal. The connector pliers and similar conventional tools do not allow for ease of use and can damage the connector shell, adjacent connectors, or the panel. Shrink sleeving applied over connector bodies to improve gripping loosens over time and results in slippage.

What is needed is a tool that is able to extend to the connector panel and securely grip an individual connector of a cable in order to tighten or loosen the connector.

SUMMARY

An example embodiment of the present disclosure provides a connector wrench having a movable jaw and a fixed jaw coupled with the movable jaw, wherein the movable jaw and the fixed jaw cooperate to engage a connector of a cabled assembly. There is a shaft coupled with the fixed jaw on a first end, wherein the connector wrench is adapted for tightening or loosening the connector of the cabled assembly.

Particular implementations may include one or more of the following features. The connector wrench has a torque limiter coupled to at least one of the shaft and the fixed jaw for limiting torque applied to the connector. The connector wrench also has a fastener connecting the movable jaw and the fixed jaw. The fastener comprises a spring-loaded mechanism on the movable jaw to apply a spring force between the fixed jaw and the movable jaw. The fixed jaw comprises at least one shaft interface for coupling the shaft to the fixed jaw. The movable jaw is designed thin to allow the connector wrench to better access connectors in confined spaces. The connector wrench also has a pivot mechanism connecting the shaft to the fixed jaw, wherein the pivot mechanism allows the fixed jaw to pivot at least about 180 degrees in one direction and change an engaging direction of the tool. Additionally, the connector wrench has a swivel mechanism connecting the shaft and the fixed jaw, wherein the swivel mechanism allows the fixed jaw to swivel less than 30 degrees in one direction. The connector wrench also has a mating connector on an opposing end of the shaft. It also has an attachment coupled to the mating connector. At least one of the movable jaw and the fixed jaw comprises a plurality of teeth. The shaft has a non-slip coating. The connector wrench also has a sleeve covering a portion of the movable jaw, where the sleeve minimizes damage to surrounding connectors.

Another example embodiment provides a method including providing a plurality of cables connectable to the panel, where the cables have a cable connector with mating receptacle on the panel. A connector wrench is provided comprising a movable jaw; a fixed jaw coupled to the movable jaw; a shaft connected to the fixed jaw; a pin or screw allowing the movable jaw to pivot with respect to the fixed jaw; a spring-loaded mechanism connecting the movable jaw and the fixed jaw; a mating connector attached to the shaft; and a torque limiter coupled to the shaft. The movable jaw is arranged around the cable connector, and the cable connector is placed in close proximity to the mating receptacle. A torsional force is applied to the shaft, wherein the force engages the cable connector with the mating receptacle, and the cable connector is adjusted.

Particular implementations may include one or more of the following features. The connector wrench makes contact solely with the cable connector being adjusted. Adjusting the cable connector comprises removing the cable connector. The movable jaw comprises a first plurality of teeth and the fixed jaw comprises a second plurality of teeth. The first plurality of teeth and the second plurality of teeth allow for incremental adjustment of a cable connector.

Implementations of the techniques discussed above may include a method or process, a system or apparatus, a kit, or a computer software stored on a computer-accessible medium. The details or one or more implementations are set forth in the accompanying drawings and the description below. Other features will be apparent from the description and drawings, and form the claims.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

This disclosure relates to a cable connector wrench and method of operation that in one example has a shaft with a pair of asymmetrical jaws at one end and a handle coupled to the other end. One jaw is a movable jaw while the other jaw is a fixed jaw. The two jaws form an assembly in which the jaws are joined with a pivot. The fixed jaw is attachable to the shaft and the movable jaw is coupled to the fixed jaw. In one embodiment the movable jaw is designed to be thinner than the fixed jaw, thereby allowing the wrench to better access connectors in confined spaces. The movable jaw and the fixed jaw cooperate to engage a connector of a cabled assembly wherein the connector wrench is adapted for tightening or loosening the connector of the cabled assembly. The connector wrench can be used for many different connector diameters, and it allows a user to tighten and loosen connectors with less effort and fatigue.

The present tool provides an easy and simple way to engage the connector body of cabled assemblies for tightening and loosening, making it easier for tightly-secured connectors to be removed. This provides ease of connector installation and removal in tight spaces and reduces the need for sequential connector mating. It also promotes consistent tightening of varied connectors from a simple tool. It is adaptable to standard drive tools, allowing it to be used with pre-existing tool sets such as standard ¼ square drive tools. The tool acts as a torque multiplier (more twisting force per operator effort) and is configured to be used in torque applications with required conversion factor.

The cable connector tool in one example has a shaft with a pair of asymmetrical jaws at one end and in one example has a handle coupled to the other end. The two jaws form an assembly in which the jaws are joined with a pivot mechanism. The fixed jaw is attachable to the shaft and the movable jaw is coupled to the fixed jaw. The tool facilitates removal/tightening of cabled connectors with tight spacing requirements such as a panel interface.

Figure 1A:
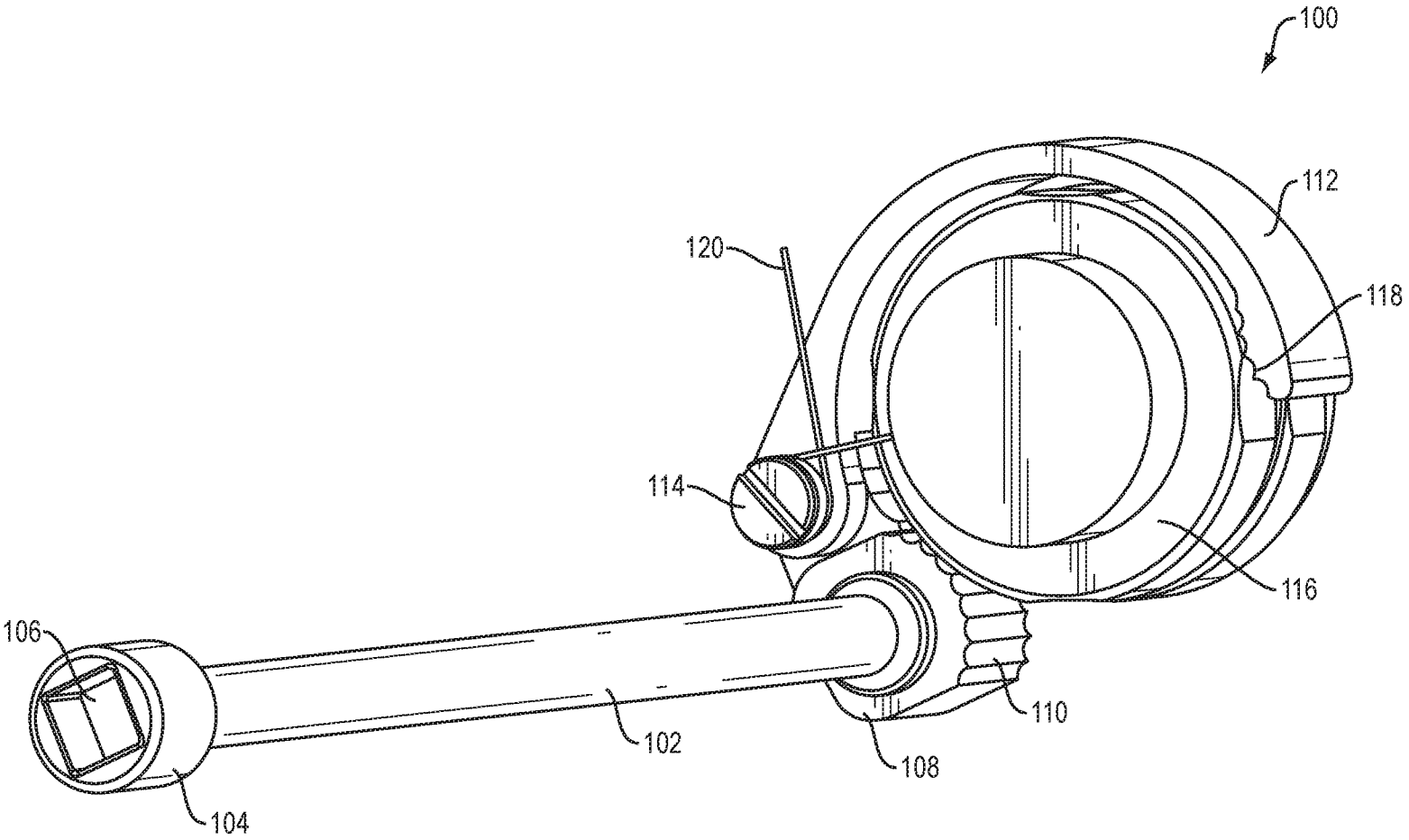
FIG. 1A is a perspective view of an embodiment of a connector wrench tool shown in use and engaging a connector.

FIG. 1A is a perspective view of an embodiment of a connector tool or wrench 100 shown in use. A pivotable or movable jaw 112 may be connected or coupled to a fixed jaw 108 by a fastener 114, which allows the movable jaw 112 to pivot. The fastener 114 may be any fastener configured to allow movable jaw 112 to pivot with respect to the fixed jaw 108. In some embodiments, the fastener 114 may comprise a spring-loaded system configured to ensure that the movable jaw 112 cooperates with the fixed jaw 108 to grip a connector 116. Some examples of fasteners include a screw, nut and bolt, rivet, or pin. The spring 120 applies a spring force from the movable jaw 112 towards the fixed jaw 108 that helps in engaging the connector 116. Additionally, the movable jaw 112 may be designed relatively thin to allow the movable jaw 112 to better access electrical connectors, which often have limited space around them. In one embodiment the thin movable jaw 112 has a thickness ranging from 0.075 to 0.150 inches. In another example the thin movable jaw 112 thickness range is about 0.060 to about 0.20 inches. This is distinguished from the typical basin wrench used for plumbing where the jaws are typically 0.5 inches or greater.

The movable jaw 112 and the fixed jaw 108 may each comprise a first plurality of teeth 118 and a second plurality of teeth 110, respectively. Teeth 118 and 110 may be configured to engage and grip the connector to allow for incremental adjustment of a connector 116 and to provide positive grip to a connector 116. Additionally, teeth 118 and 110 may be made from various materials in order to accommodate different types of connectors. In some embodiments, teeth 118 and 110 may be made from metal, plastic or rubber. In some embodiments, teeth 118 and 100 may also be detachable and replaceable. The teeth size, position and amount of teeth are variable depending upon the connector. As shown in this embodiment, the teeth 118 may protrude from the movable jaw 112 to contact the connector 116. When plastic or rubber materials are used, teeth may not be required, relying only on the materials' friction and force against the connector shell. Additionally, the movable jaw 112 and the fixed jaw 108 may have a soft jaw grip area that minimizes any damage to the connector being serviced. The connector wrench may also have a protective sleeve that covers parts of the wrench in order to minimize damage to surrounding connectors and other features.

The fixed jaw 108 in this example is connected to a shaft 102 which may optionally comprise a non-slip grip coating. This may provide enhanced connector gripping, which can reduce user fatigue. The shaft 102 may also be extendable or telescoping and include a shaft interface or drive mechanism on the opposing end to allow coupling to a t-bar, socket wrench and similar tools. In some examples, the shaft interface may be a standard ¼" square drive, a ⅜" square drive, a ¼" hex drive, or a 3/16" hex drive depending on the size of connector. In this example, a mating connector 104, comprising a female mating component 106, may be attached to the end of the shaft 102 such that a t-handle or another attachment may be connected to the shaft 102. Some examples of attachments may include a t-bar, a handle, a telescoping shaft, a socket wrench, and a torque wrench. In some embodiments, the mating handle interface 104 includes a torque limiting component configured to prevent excessive torsional force on a connector 116 in order to avoid damage or to provide a controlled locking or mating torque to a connector 116.

The typical torque requirements for the connectors 116 range from about 2-45 in-lbs for small to large connector sizes. Large diameter connectors such as 3 inches in diameter can require up to 90 in-lbs of torque. The panel connectors 116 may have mating pins within the connector such that applying too much torque could damage the connector pins. In contrast, the typical basin wrench used in plumbing is designed to grasp faucet nuts that range from 0.5 to 1.0 inches and require high levels of torque to loosen corroded connectors and ensure water tight seals. In one example the torque required for the plumber's basin wrench could be 20 ft-lbs or more of torque.

Figure 1B:
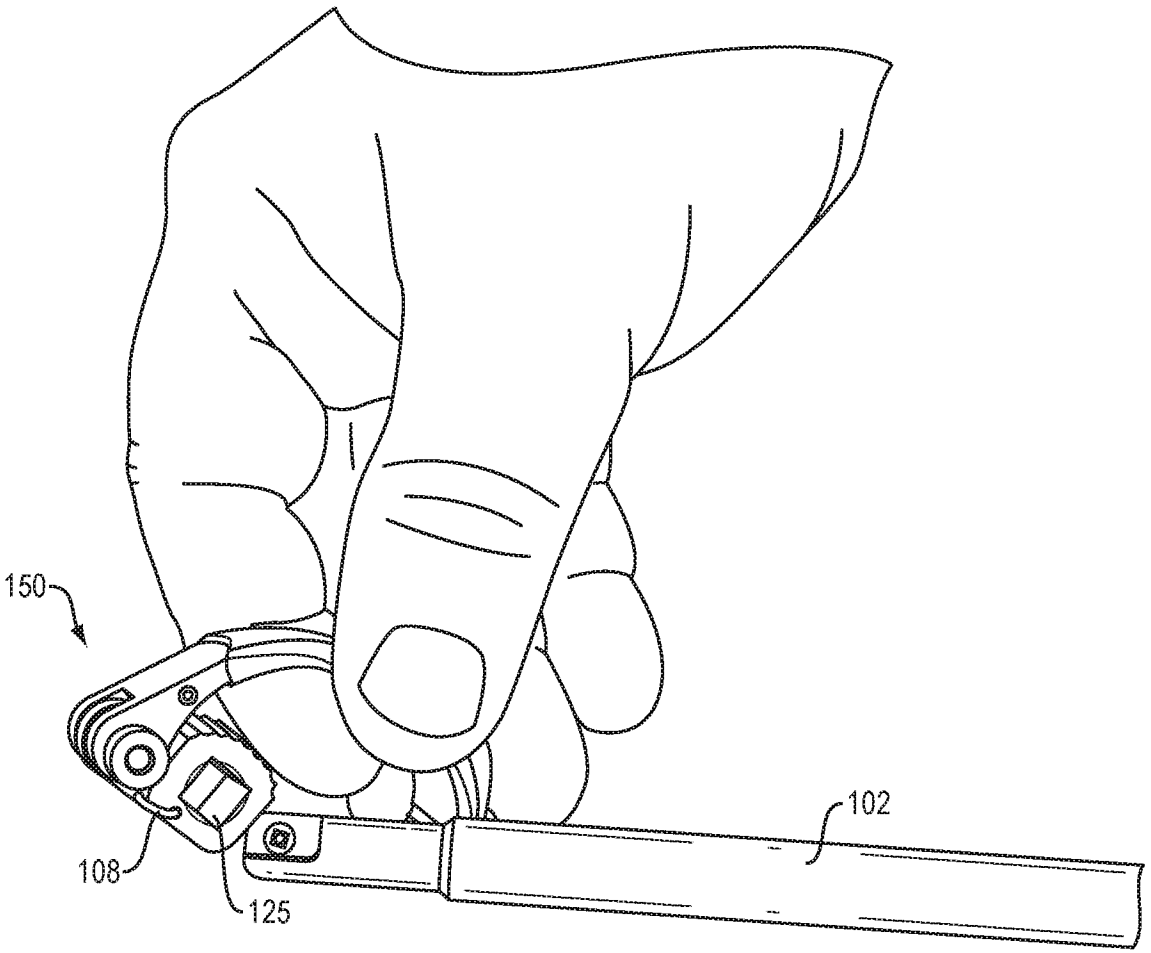
FIG. 1B is an illustration of a further embodiment showing the shaft disconnected from the gripping section.

As illustrated in FIG. 1B, according to one embodiment, the shaft 102 is separable from the fixed jaw 108 and inserted into a receptacle 125 on at least one side of the fixed jaw 108. This allows the gripping portion 150 to be easily attached to the shaft 102.

Figure 1C:
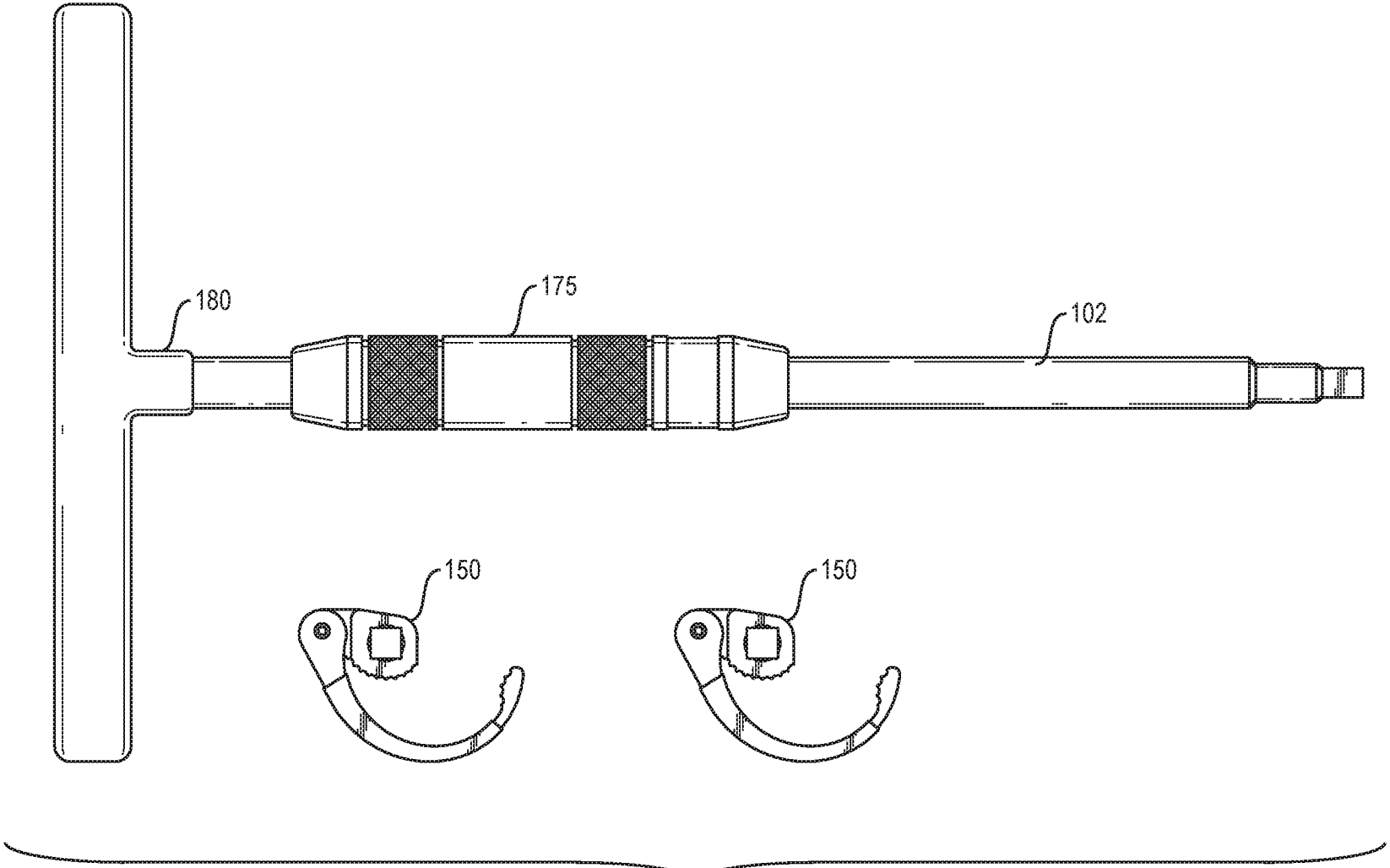
FIG. 1C shows another embodiment of the tool with a t-bar handle and mid-section feature.

FIG. 1C shows the connector tool in a further embodiment having a t-bar handle 180 coupled to the shaft 102. In this example there is a mid-section 175 that includes a gripping feature with one or more sections of textured surface to allow a user to hold and/or rotate the shaft. The mid-section 175 in one example can include receptacles on each end such that the handle can be inserted into one end of the section and/or the shaft can be inserted into the opposing end of the section. In one example the mid-section 175 can include a torque limiter that prevents over-tightening and ensures consistent attachment of the connectors. There can be various sections for the shaft and/or the handle to accommodate access at varying distances. There are gripping portions 150 shown for different sized connectors wherein the gripping portions 150 are coupled to the shaft 102 in the correct orientation for tightening or loosening. In one example the connector wrench is assembled from a kit having at least on gripping element with the moveable jaw and fixed jaw that pivot and enable gripping a connector. There is a shaft that engages a receptacle of the gripping element on one end. On the other end of the shaft is a handle that makes it easier to turn the gripping element.

Figure 1D:
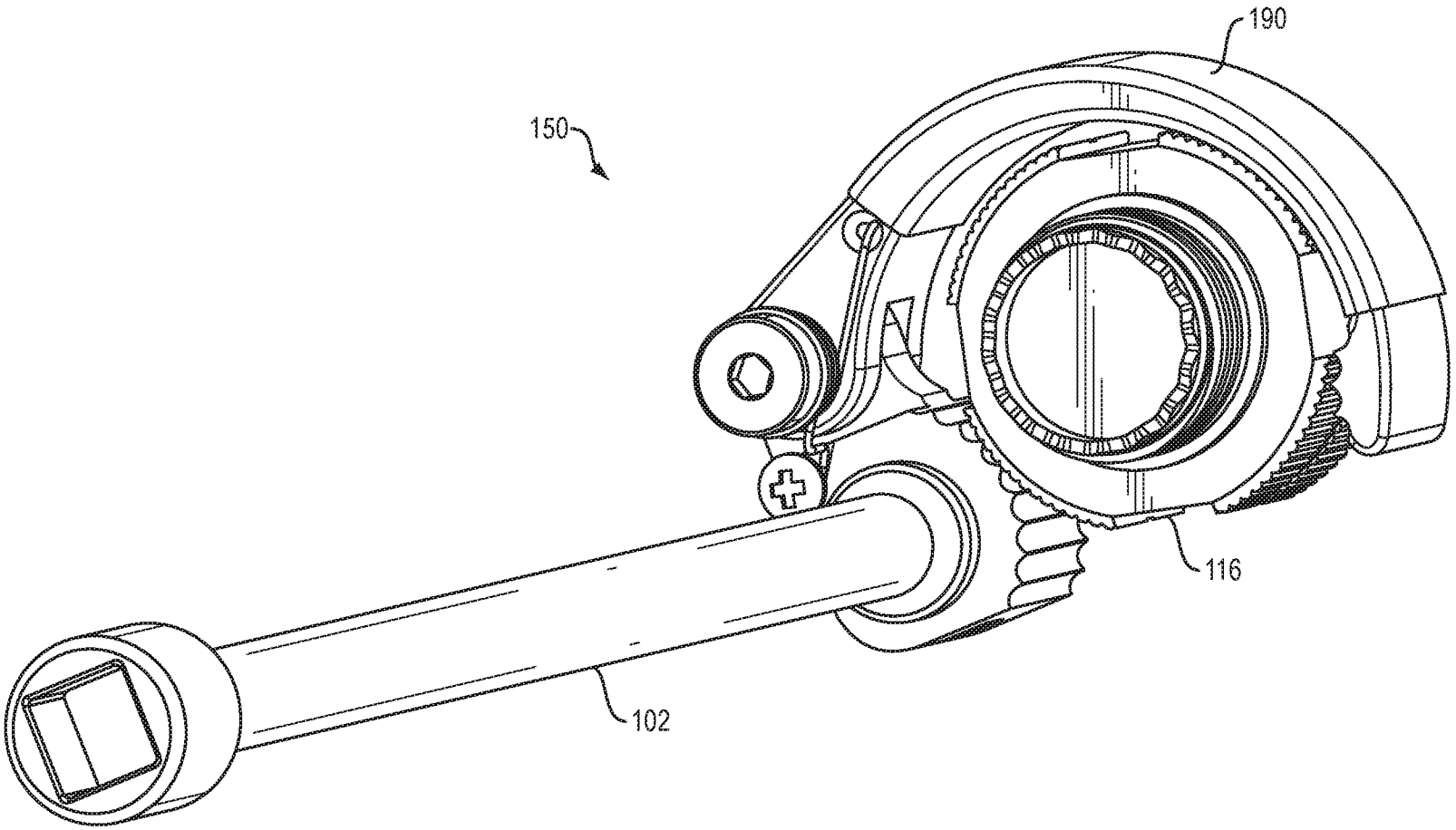
FIG. 1D illustrates an embodiment for loosening the connector.

FIG. 1D illustrates and example of the gripping portion 150 engaging the shell connector 116 in a direction intended to loosen the connector 116. Note the protruding portion of the movable jaw engages a section of the connector while the inner portion of the movable jaw may be slightly separated from direct contact with the connector 116. A sleeve 190 covers a section of the movable jaw to prevent marring of the connector surface.

Figure 1E:
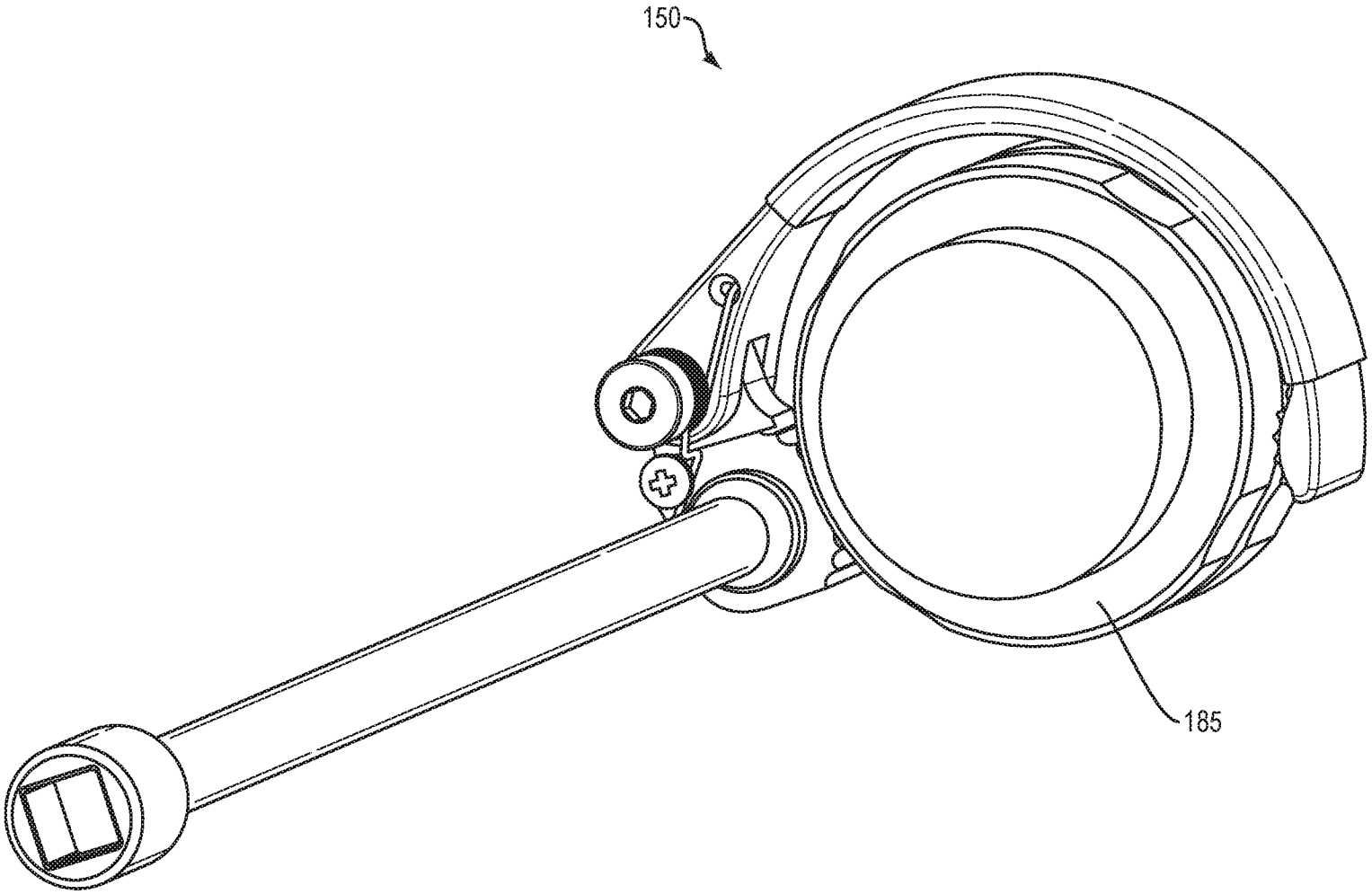
FIG. 1E illustrates an embodiment for loosening the connector.

FIG. 1E is a further illustration of the gripping portion 150 engaging a different connector 185 in the loosening direction.

Figure 1F:
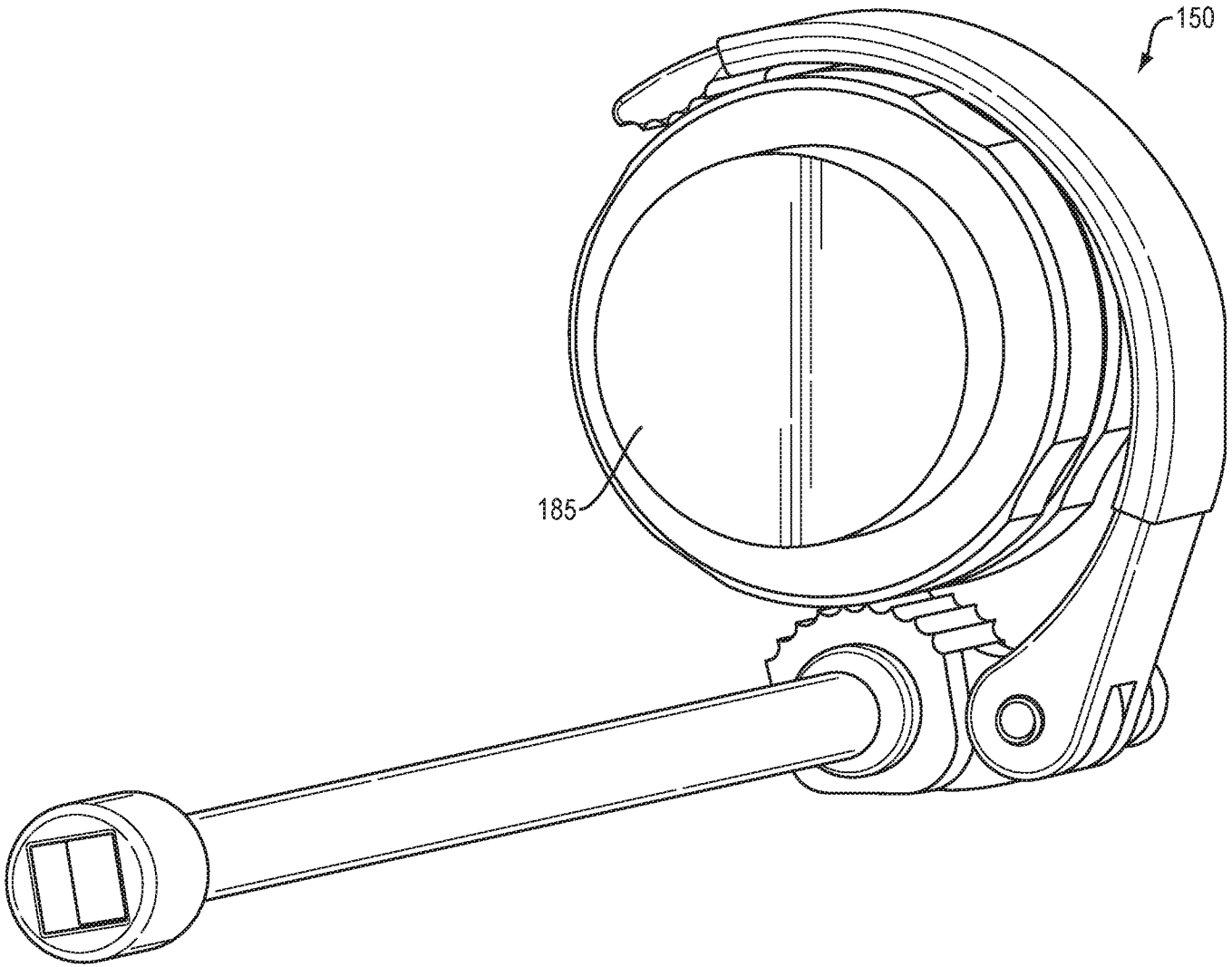
FIG. 1F illustrates an embodiment for tightening a different connector.

Referring to FIG. 1F, the gripping portion 150 engages the connector 185 in the tightening direction.

The connector wrench 100 may be made in various sizes to accommodate different types of connectors. In a further embodiment a swivel mechanism (not shown) provides additional flexibility to allow the fixed jaw to swivel in one direction by about 30 degrees which aids in being able to clear obstacles and is commonly used in socket wrenches.

Figure 2A:
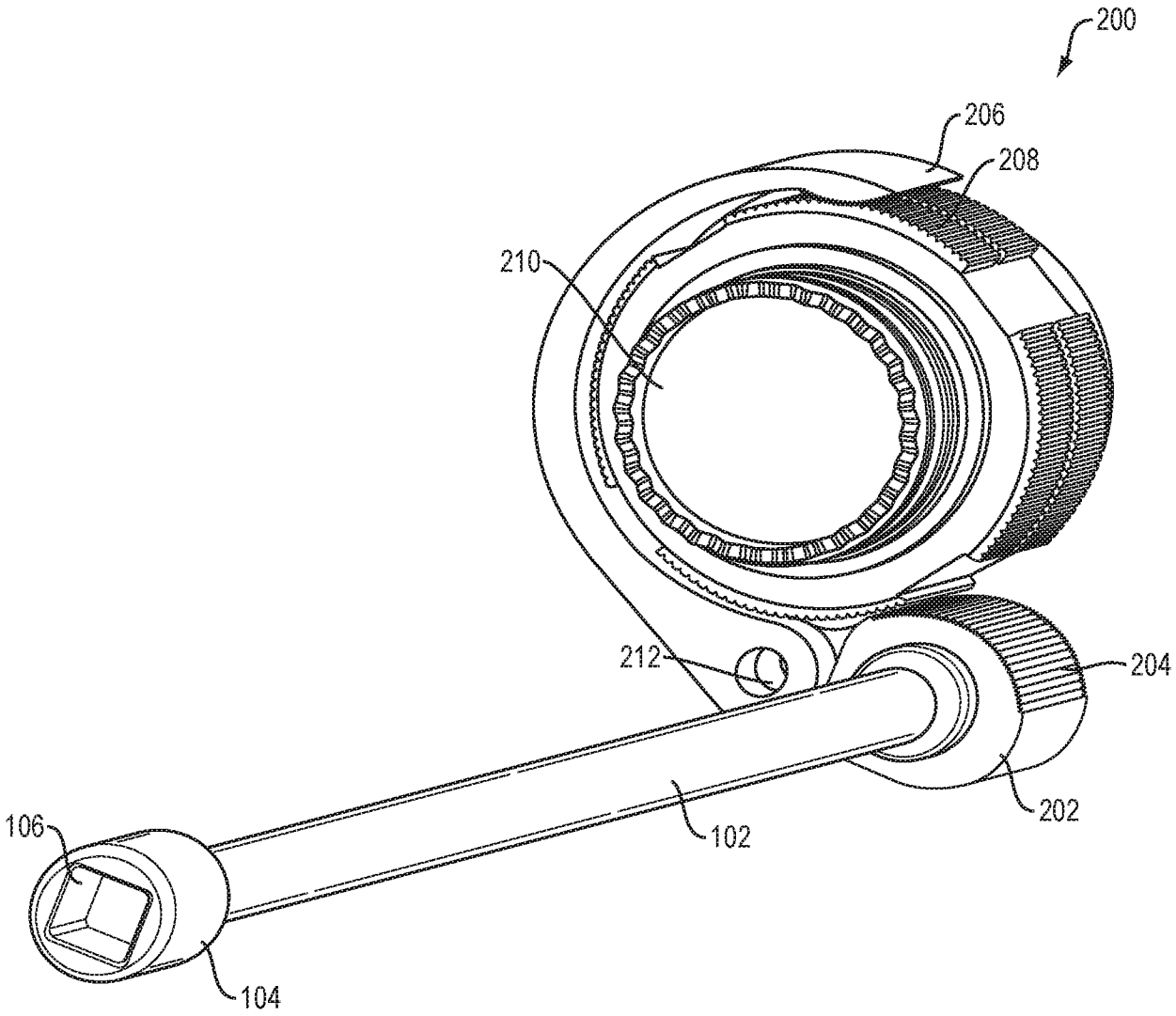
FIG. 2A is a perspective view of a further embodiment of the connector wrench shown in use and engaging a connector.

FIG. 2A is a perspective view of an embodiment of a connector wrench 200 shown in use. A movable jaw 206 is connected to a fixed jaw 202 by a fastener 212 which allows the movable jaw 206 to pivot. The fastener 212 may be any fastener configured to allow movable jaw 206 to pivot with respect to the fixed jaw 202. In some embodiments, the fastener 212 may comprise a spring-loaded system configured to ensure that the movable jaw 206 fits snugly around a connector 210 while in use. Additionally, the movable jaw 206 may be designed thin to allow the movable jaw 206 to better access electrical connectors, which often have limited space around them.

The movable jaw 206 and the fixed jaw 202 may each comprise a first plurality of teeth 208 and a second plurality of teeth 204, respectively. Teeth 208 and 204 are smaller than the teeth 118 and 110 shown in FIG. 1. Accordingly, teeth 208 and 204 may allow for improved gripping of certain types of connectors 210 such as those that are die cast. Furthermore, teeth 208 and 204 may be made from various materials in order to accommodate different types of connectors. In some embodiments, teeth 208 and 204 may be made from plastic or rubber to help avoid marring the connector surface and/or for gripping. In other embodiments a sleeve (not shown) is placed around arm section of movable jaw 206 to protect adjacent connectors or objects from scratches. The fixed jaw 202 may be connected to a shaft 102, which may comprise the features detailed herein. The connector wrench 200 may be made in various sizes to accommodate different types of connectors.

Figure 2B:
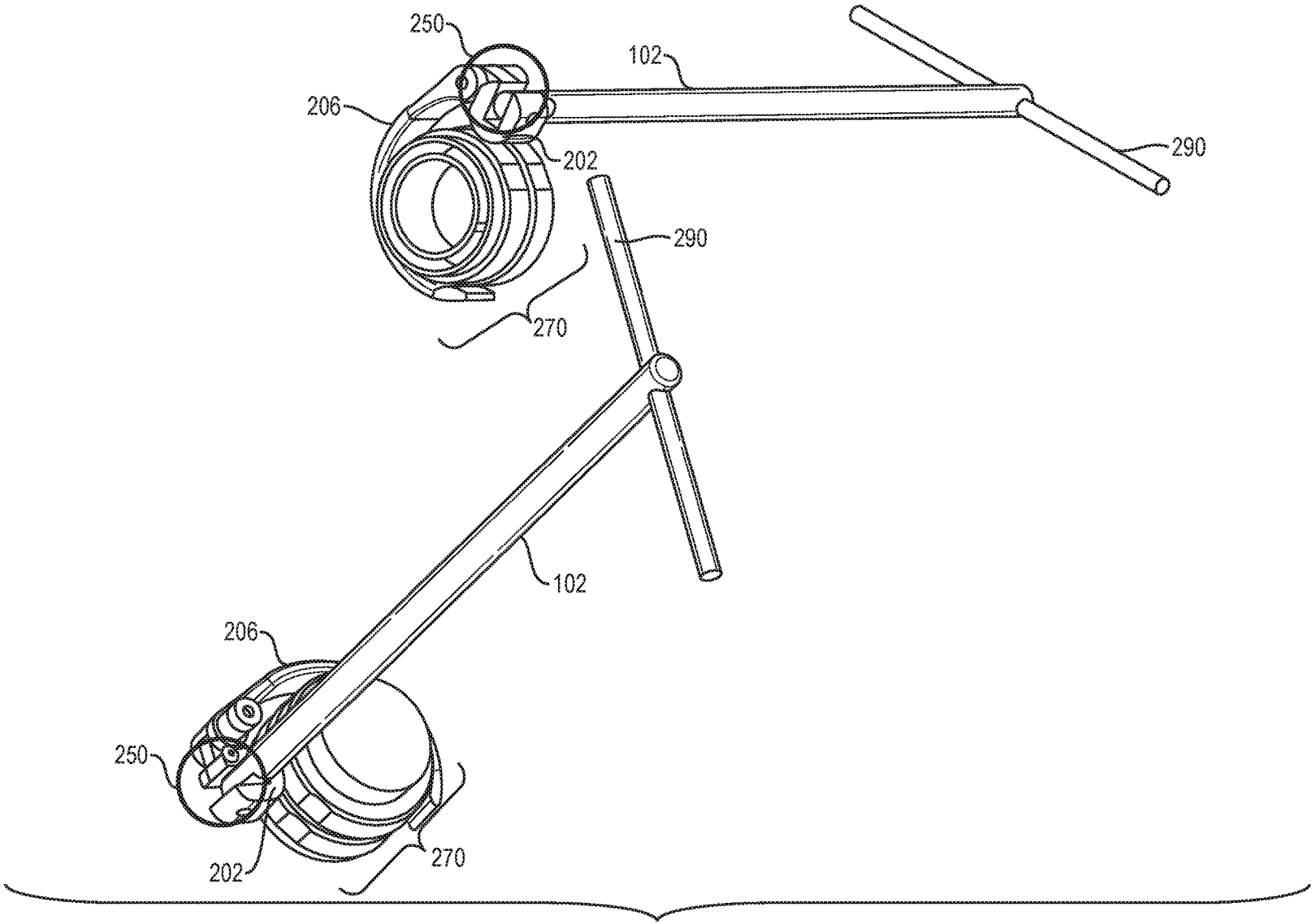
FIG. 2B is a perspective view of a further embodiment of the connector wrench shown in use and engaging a connector and having a pivoting gripping section.

Referring to FIG. 2B, some embodiments incorporate a pivot mechanism 250 at the proximal end of the shaft 102, which connects the shaft 102 to the fixed jaw 202. The pivot mechanism 250, such as used in a basin wrench, allows the gripping portion 270 to pivot as needed to change the direction such as flipping 180 degrees and go from untightening the connector to tightening the connector (or vice versa).

FIG. 2B is an embodiment showing the fixed jaw 202 coupled to the shaft 102 that allows the fixed jaw 202 and movable jaw 206 to rotate about the shaft 102 such that it can be easily flipped from tightening to untightening and vice versa. In this example, a t-bar 290 is inserted through the shaft 102 at an opposing end allowing the user to have torque with respect to the connector (not shown). The shaft 102 extends through the fixed jaw 202 and has a connector (not shown) that allows the gripping portion 270 to rotate about the shaft.

Figure 2C:
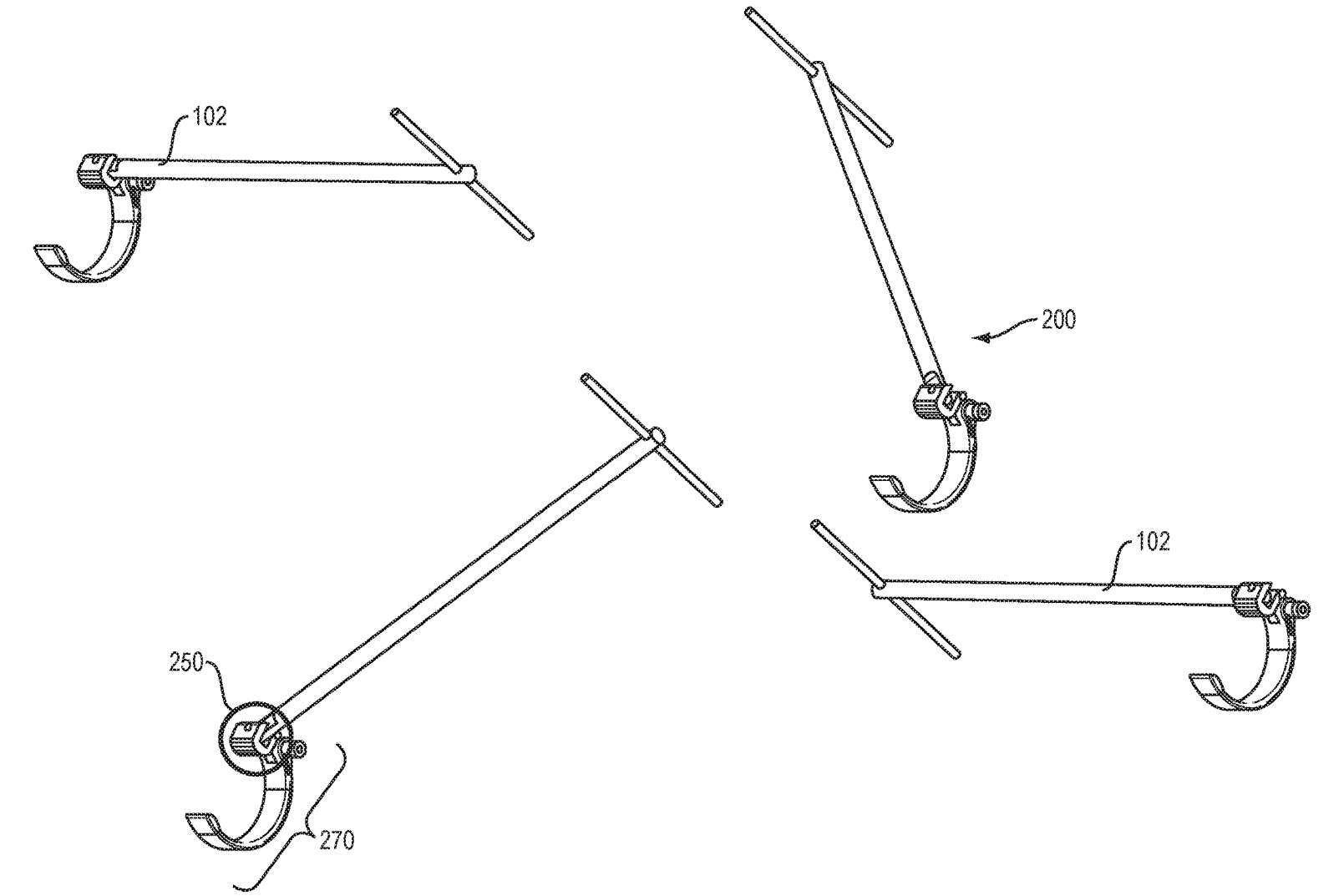
FIG. 2C is a perspective view of an embodiment of the connector wrench with a t-bar handle in varying positions to demonstrate the pivot mechanism.

FIG. 2C shows various perspective views of an embodiment of the connector wrench with a t-bar 290 in varying positions to demonstrate the pivot mechanism 250. The pivot mechanism 250 allows the gripping portion 270 of the connector wrench 200 to change direction as needed. For example, by flipping the shaft 102 180 degrees, a user can readily tighten or loosen the connector.

Figure 3:
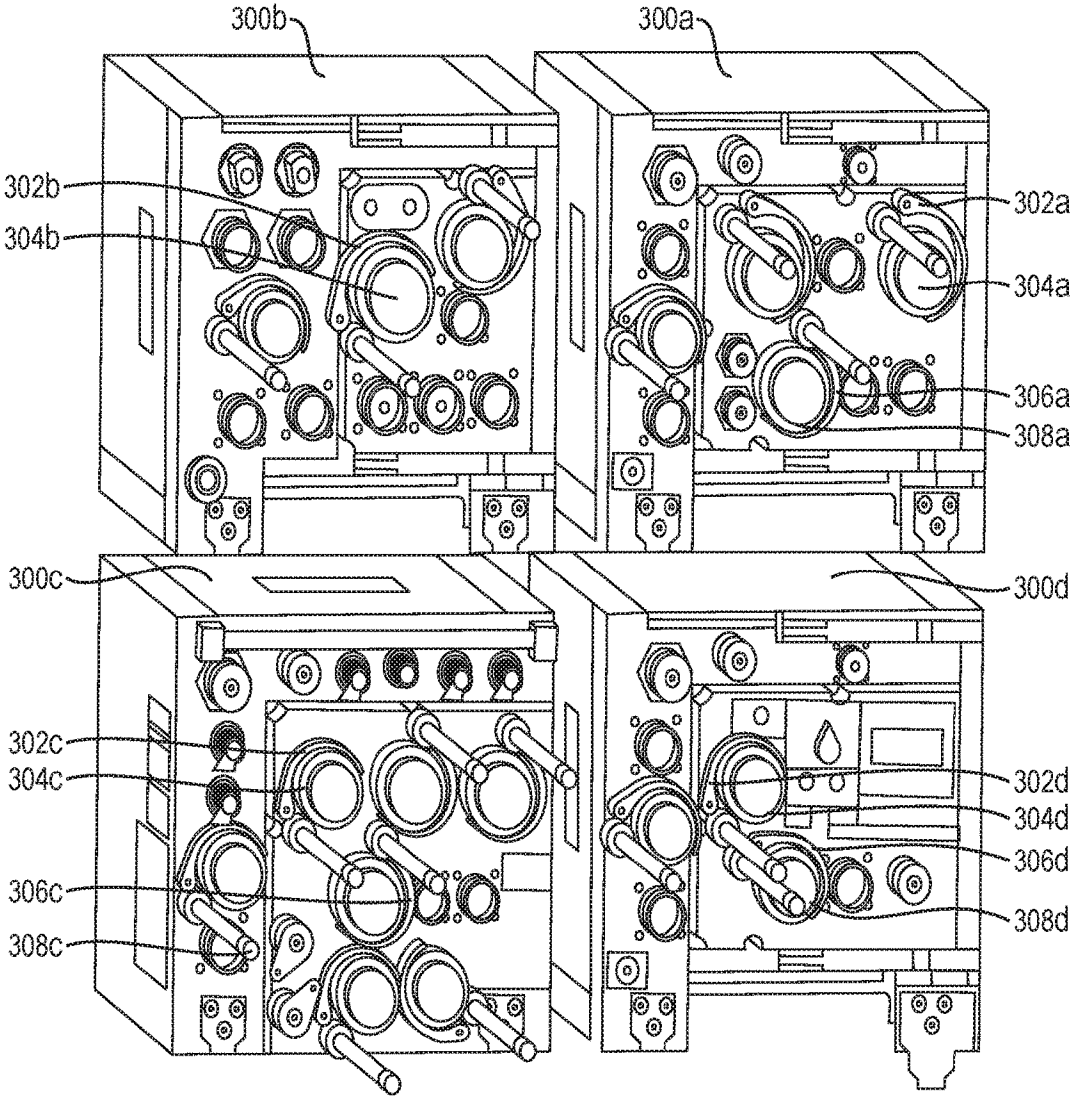
FIG. 3 is a perspective view of several embodiments of connector wrenches shown in use on multiple modules with varied connectors.

FIG. 3 is a perspective view of several embodiments of connector wrenches shown in use and connected to various cabled connectors on multiple panel modules. For ease of illustration, the cables that connect to the connectors are not shown. Various sizes of connector wrenches are necessary to make adjustments to different types of connectors. In one example, the panels 300*a-d* are Multifunctional Information Distribution Systems (MIDS's), each comprising a multitude of different connectors for various cables. In other examples the cables can be the same or similar cables. For example, in some embodiments, at least one of the connectors 304*a-d* may be coolant line, electrical cable, and/or signal cables. For certain types and sizes of connector, a differently-sized connector wrench may be used. In some embodiments, connector wrenches 302*a-d* may each have a different size, depending on what type of connector they are coupled with. For example, shell connector sizes may range from 9, 11, 13, 15, 17, 19, 21, and 23, and the connector wrenches 302*a-d* may have different gripping sections for certain sets of the connectors. In some embodiments, the connector wrench may be compatible with connector diameters ranging from 0.5 inches to 2.0 inches. However, the connector wrench is not limited to just this range and can be used for larger diameters such as 3.0 inches.

As shown in FIG. 3, the connector wrenches 302*a-d* are sized such that they easily fit between connectors such that cabling does not need to be unnecessarily removed in order to make a single adjustment. A user may easily adjust a single connector without disturbing other cabling or connectors. The movable jaws of the connector wrenches may be designed to be thin relative to the fixed jaw, thereby allowing the connector wrench to better access the connectors in such confined spaces.

Figure 4A:
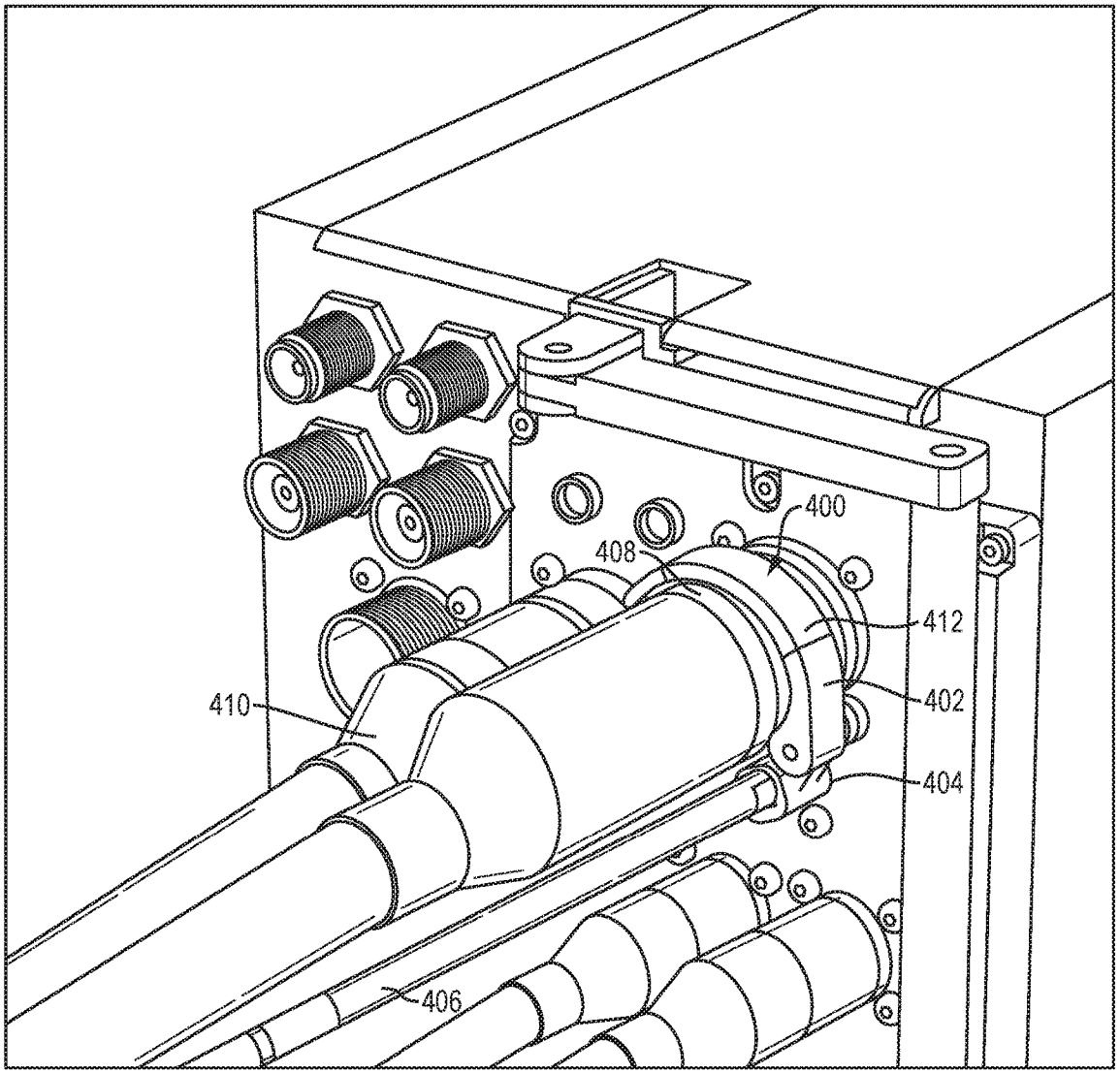
FIG. 4A shows an embodiment of a connector wrench shown in use on a panel.

FIG. 4A is a view of an embodiment of a connector wrench shown in use. As shown, the connector wrench 400 may be used to adjust a connector 408 within a tight area without disturbing other connectors that may also be present, and without requiring an adjacent cable 410 to be removed from the panel prior to adjustment.

A movable jaw 402 may be connected to a fixed jaw 404, and the movable jaw 402 may comprise a sleeve portion 412 made from a different material than the rest of the movable jaw 402. The use of a different material may aid in gripping certain connectors without causing undue damage to connector or adjacent connectors. In some embodiments, the sleeve portion 412 may be made from plastic and may cover some or all of the teeth of the movable jaw 402. In other embodiments, the sleeve portion 412 may be made from rubber. A shaft 406 may be insertably or permanently (when a pivot feature is employed) attached to the fixed jaw 404.

Figure 4B:
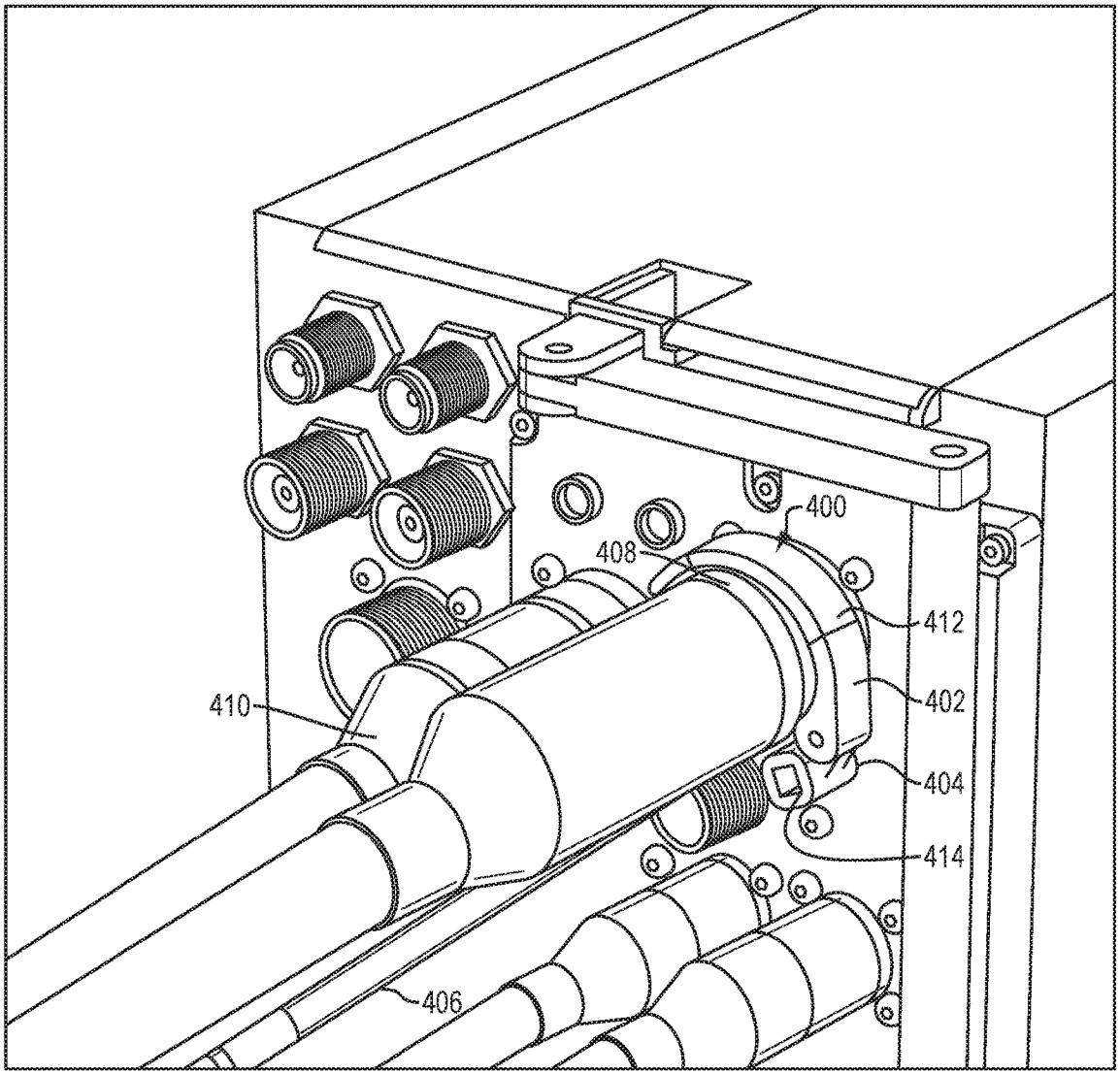
FIG. 4B shows a further embodiment of the connector wrench shown in FIG. 4A.
Figure 4C:
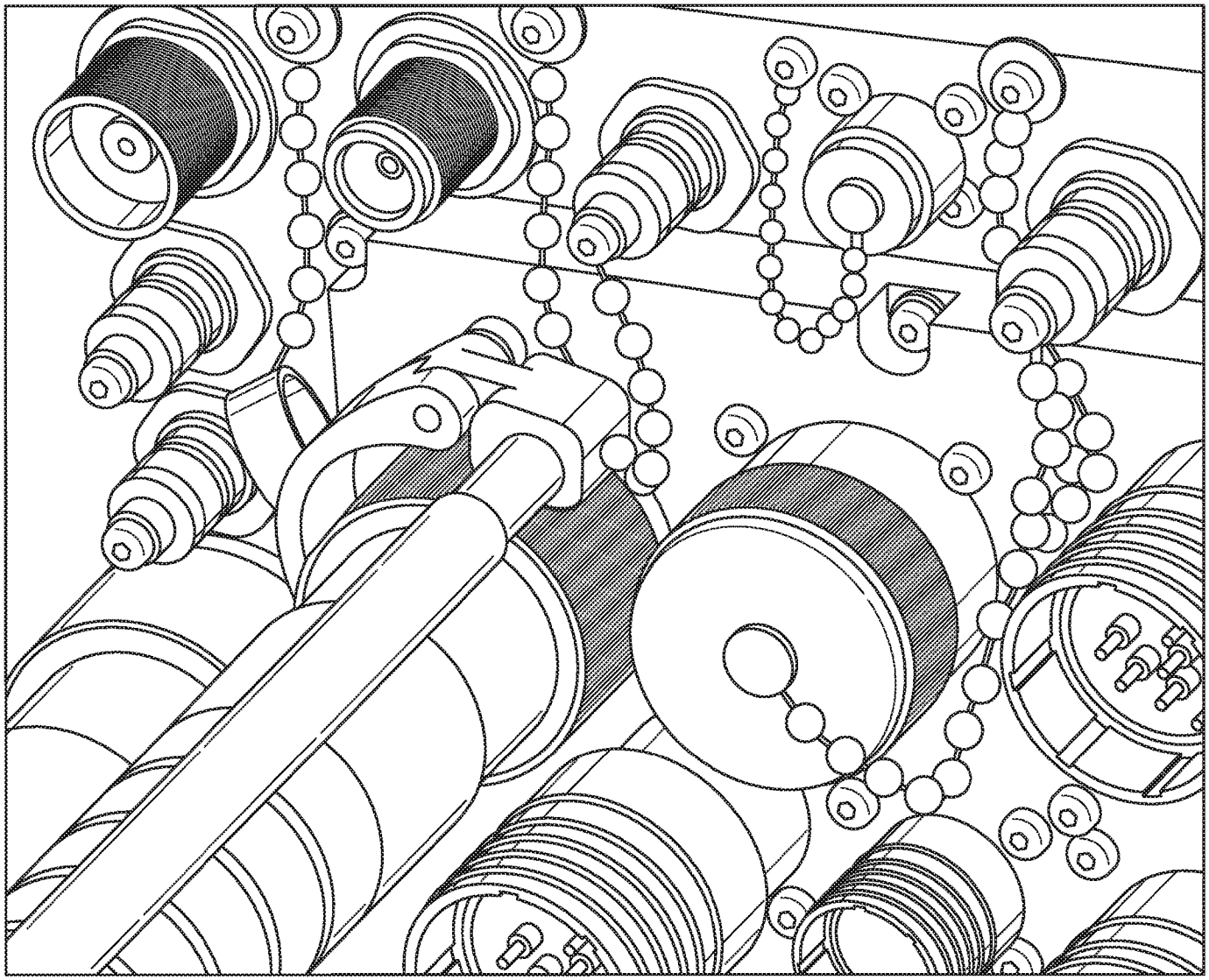
FIG. 4C shows a close-up view of an embodiment of a connector wrench shown in use on a panel.

FIG. 4B is a second view of an embodiment of a connector wrench shown in FIG. 4A. FIG. 4B shows the insertable shaft 406 disconnected from the fixed jaw 404 and the shaft interface 414 that allows for insertion of the shaft 406 into the fixed jaw 404. In this embodiment, the shaft 406 and the fixed jaw 404 are not fastened together, but rather are removably coupled such that the shaft 406 may be freely removed or inserted into the fixed jaw 404. Such a design gives the user greater ability to position the connector wrench in any orientation around a connector 408. In a further embodiment the fixed jaw has two or more shaft interfaces such that the insertable shaft to facilitate attachment to the fixed jaw. A close up view of the wrench engaged to the connector is shown in FIG. 4C.

Figure 5:
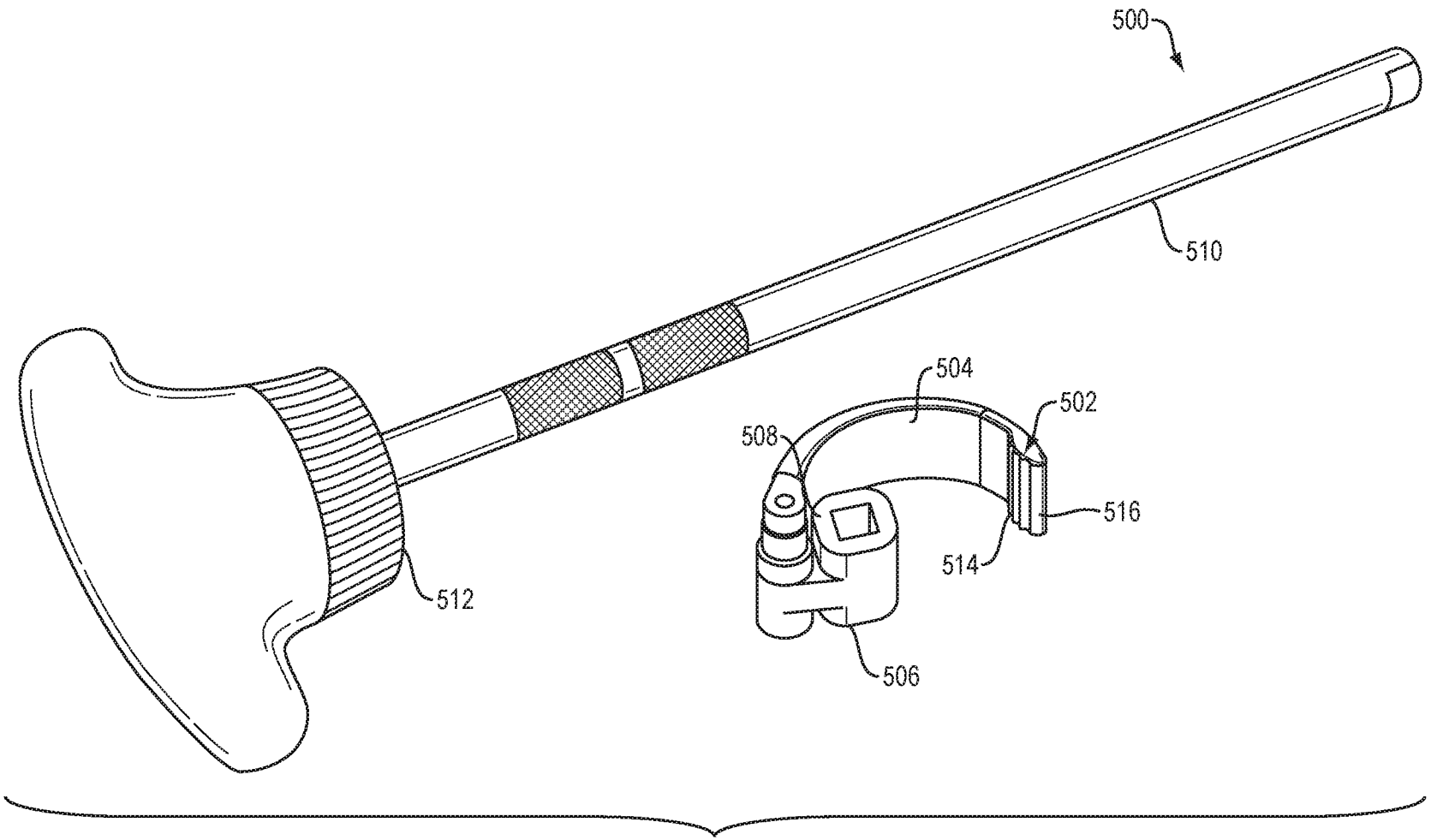
FIG. 5 is a partially exploded view of an embodiment of the connector wrench with a ratcheting handle.

FIG. 5 is a partially exploded view of an embodiment of the connector wrench assembly. The connector wrench 500 in this example comprises a movable jaw 502 connected to a fixed jaw 506. In one embodiment the movable jaw 502 is made from two different materials. A first section 514 of movable jaw 502 may be made from a first material, while a second section 504 may be made from a second material. The first section 514 may be made from a metal, a plastic, or a rubber. The second section 504 may be made from the same material as the first section 514, or from a different metal, plastic, or rubber. Selection of materials depends on the type of connector being adjusted. In another example, the second section 504 is a sleeve that is placed around at least a portion of the movable jaw 502. The first section 514 may also comprise a plurality of teeth 516 which may aid in gripping and incremental adjustment of a connector. The fixed jaw 506 in this example includes a shaft interface 508 that allows a shaft 510 to be removably inserted into the fixed jaw 506. The shaft 510 in this example can be coupled with a t-bar or handle or ratcheting attachment 512 to allow for ease of use.

Figure 6A:
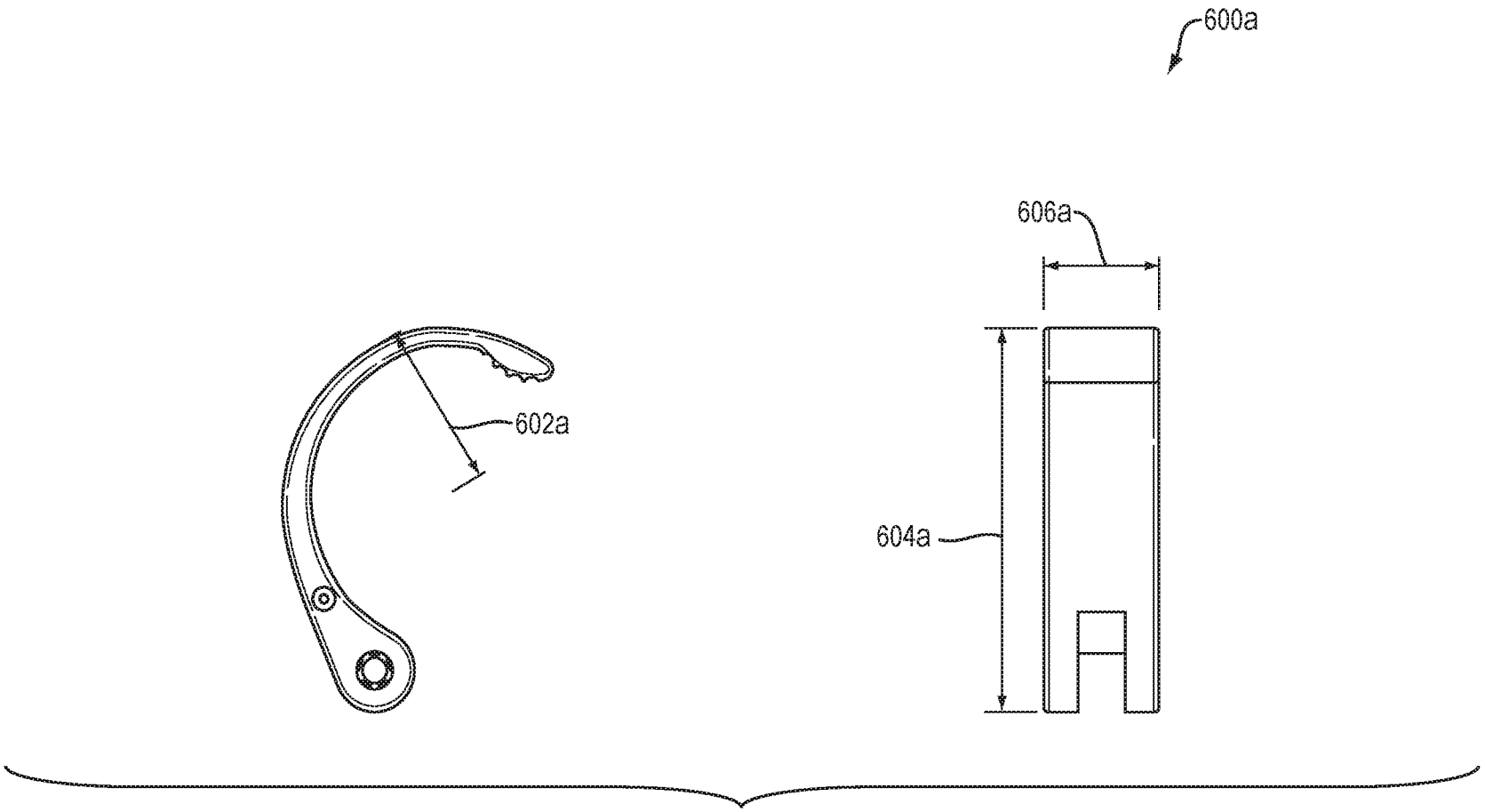
FIG. 6A is a dimensioned side view of one embodiment of the movable jaw of the connector wrench.

FIG. 6A is a dimensioned side view of one embodiment of a movable jaw 600A of the connector wrench. It should be understood that the dimensions are for illustrative purposes of certain examples of the present design. In some embodiments, the radius 602A of the movable jaw 600A may range from about ⅝" to about ¾". In such embodiments, the height 604A of the movable jaw 600A may range from about 1.5" to about 1.6", and the width 606A of the movable jaw 600A may range from about ⅜" to about ⅝". The teeth are shown as protruding from the movable jaw.

Figure 6B:
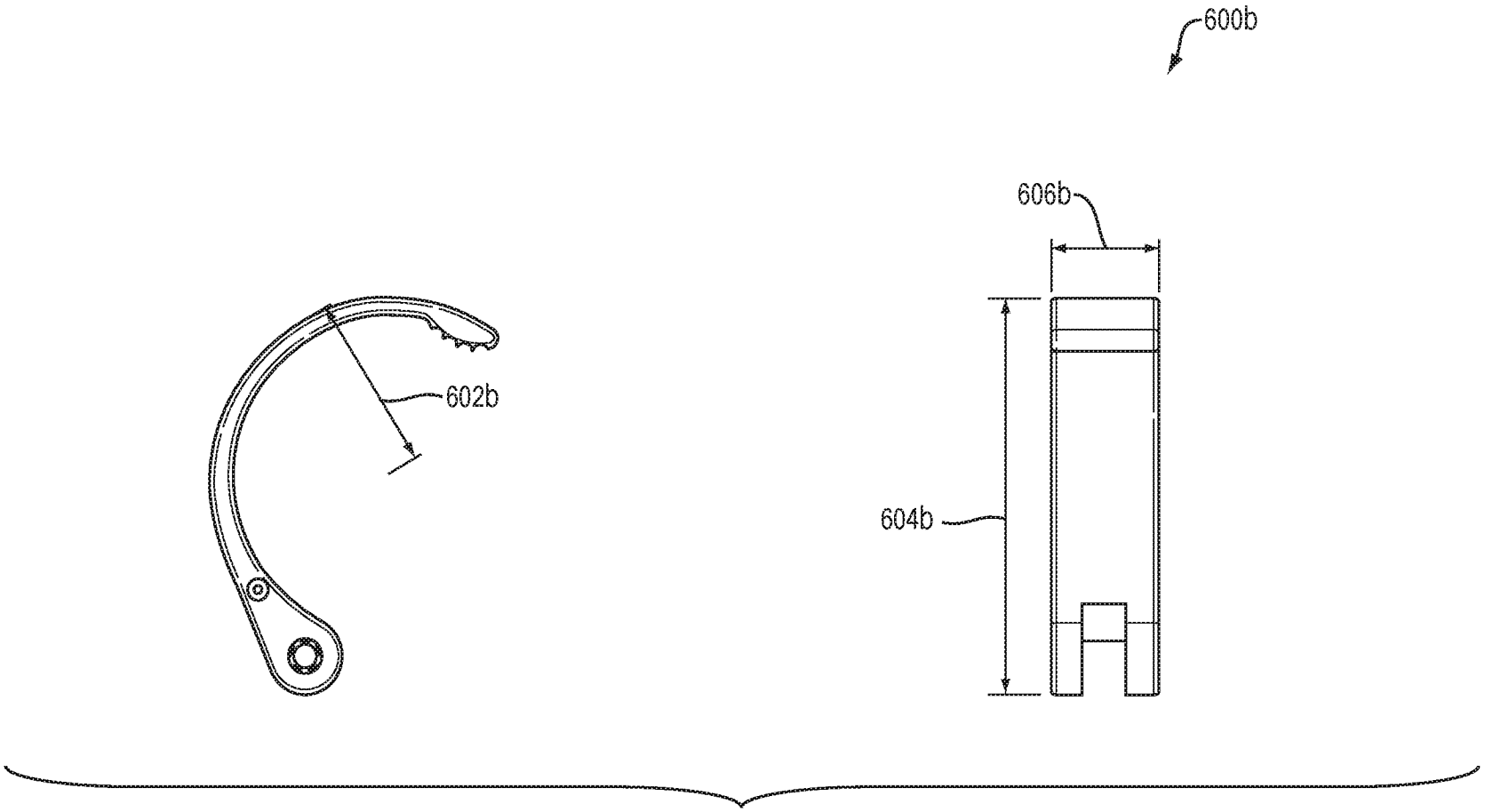
FIG. 6B is a dimensioned side view of a further embodiment of the movable jaw of the connector wrench.

FIG. 6B is a dimensioned side view of an embodiment of a movable jaw 600B of the connector wrench. In some embodiments, the radius 602B of the movable jaw 600B may range from about ¾" to about ⅞". In such embodiments, the height 604B of the movable jaw 600B may range from about 1.7" to about 1.9", and the width 606B of the movable jaw 600B may range from about ⅜" to about ⅝".

Figure 6C:
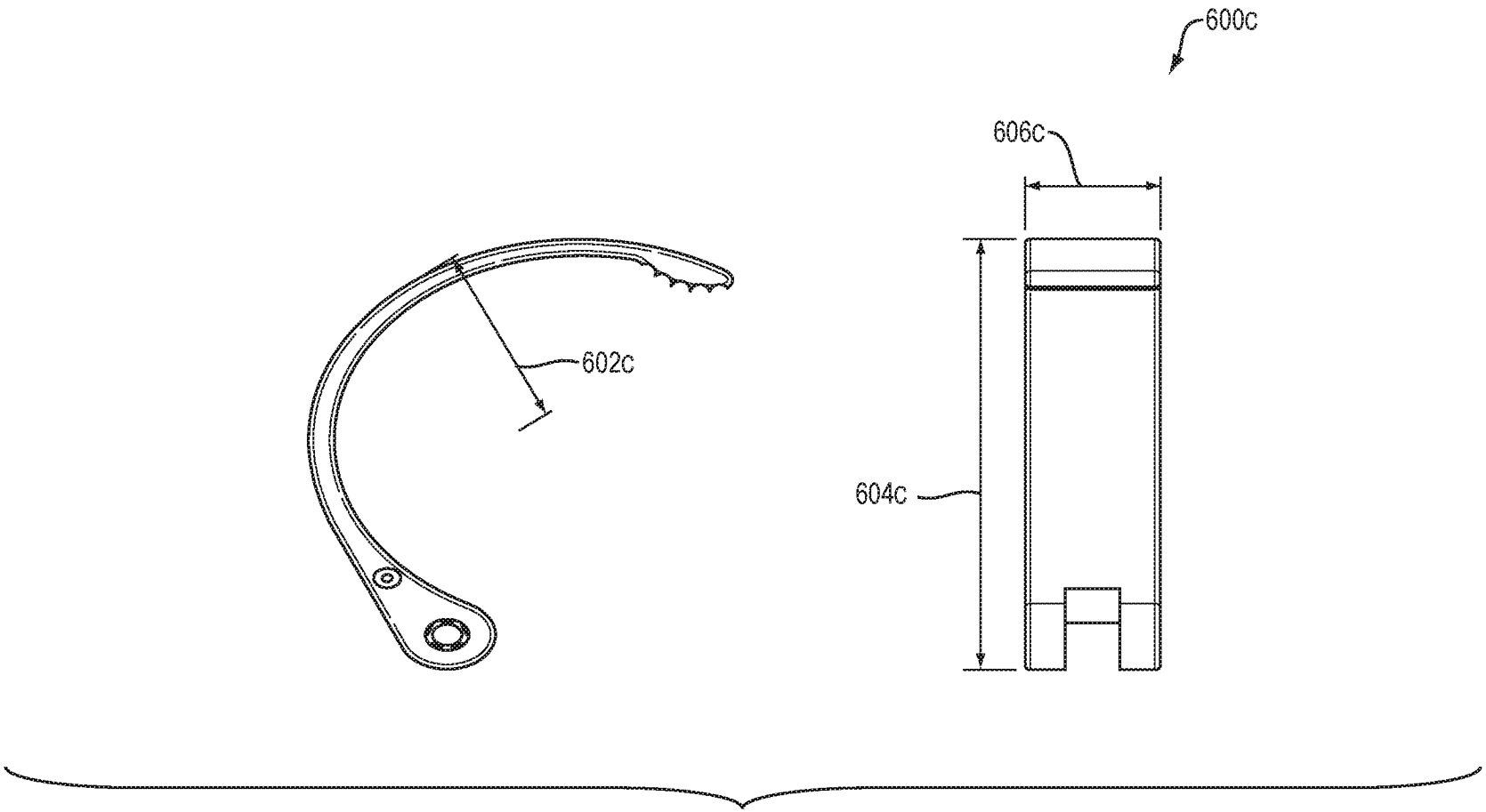
FIG. 6C is a dimensioned side view of another embodiment of the movable jaw of the connector wrench.

FIG. 6C is a dimensioned side view of an embodiment of a movable jaw 600C of the connector wrench. In some embodiments, the radius 602C of the movable jaw 600C may range from about ⅞" to about 1⅛". In such embodiments, the height 604C of the movable jaw 600C may range from about 2" to about 2.25", and the width 606C of the movable jaw 600C may range from about ⅜" to about ⅝".

Figure 7:
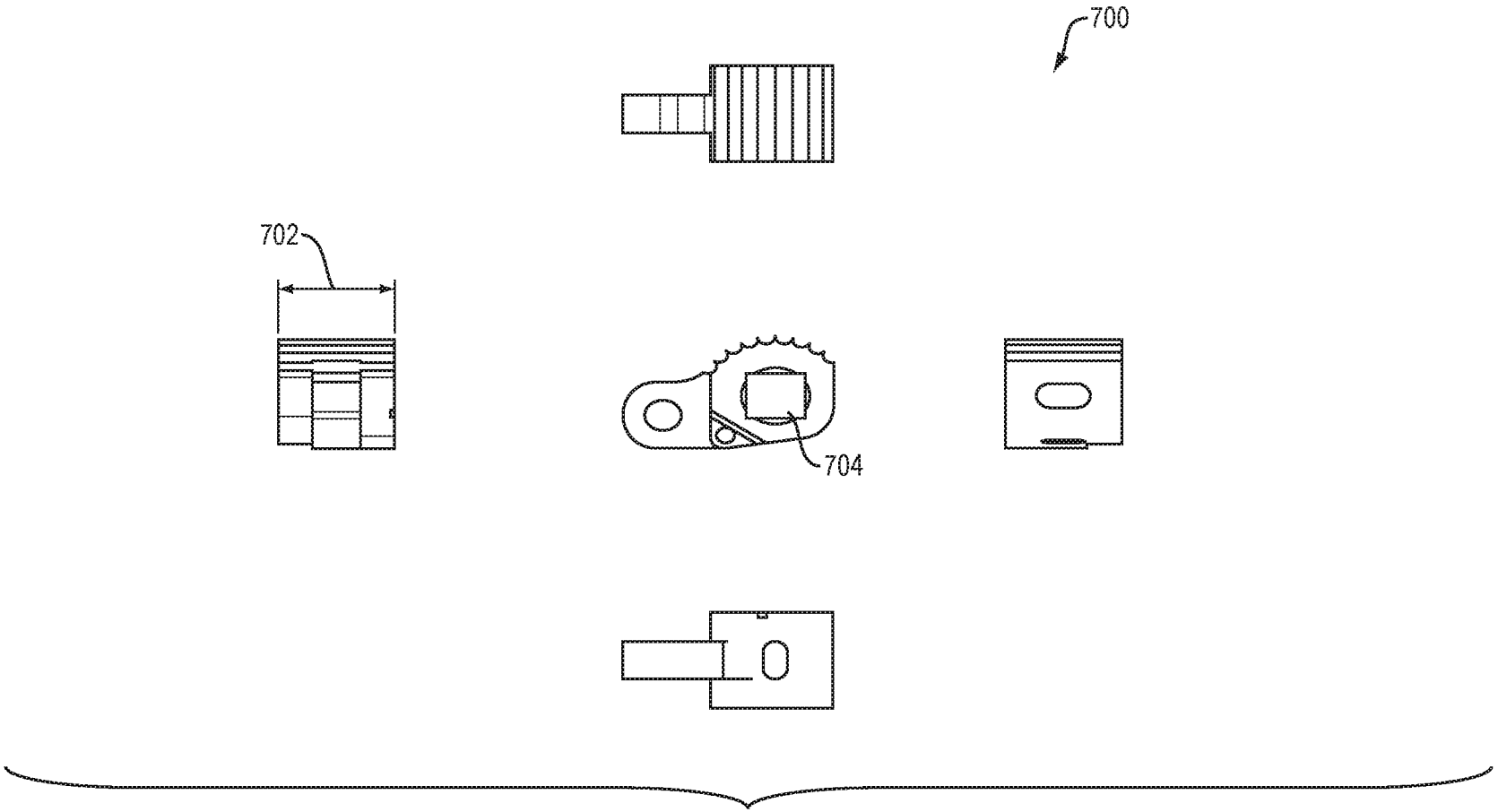
FIG. 7 shows multiple dimensioned views of an embodiment of the fixed jaw of the connector wrench.

FIG. 7 shows multiple dimensioned views of an embodiment of a fixed jaw 700 of the connector wrench. In some embodiments, the width 702 of the fixed jaw 700 may range from about ⅜" to about ⅝". In such embodiments, the length and width of the square shaft interface 704 may range from about 3/16" to about ½" and may also be hex shaped.

Figure 8:
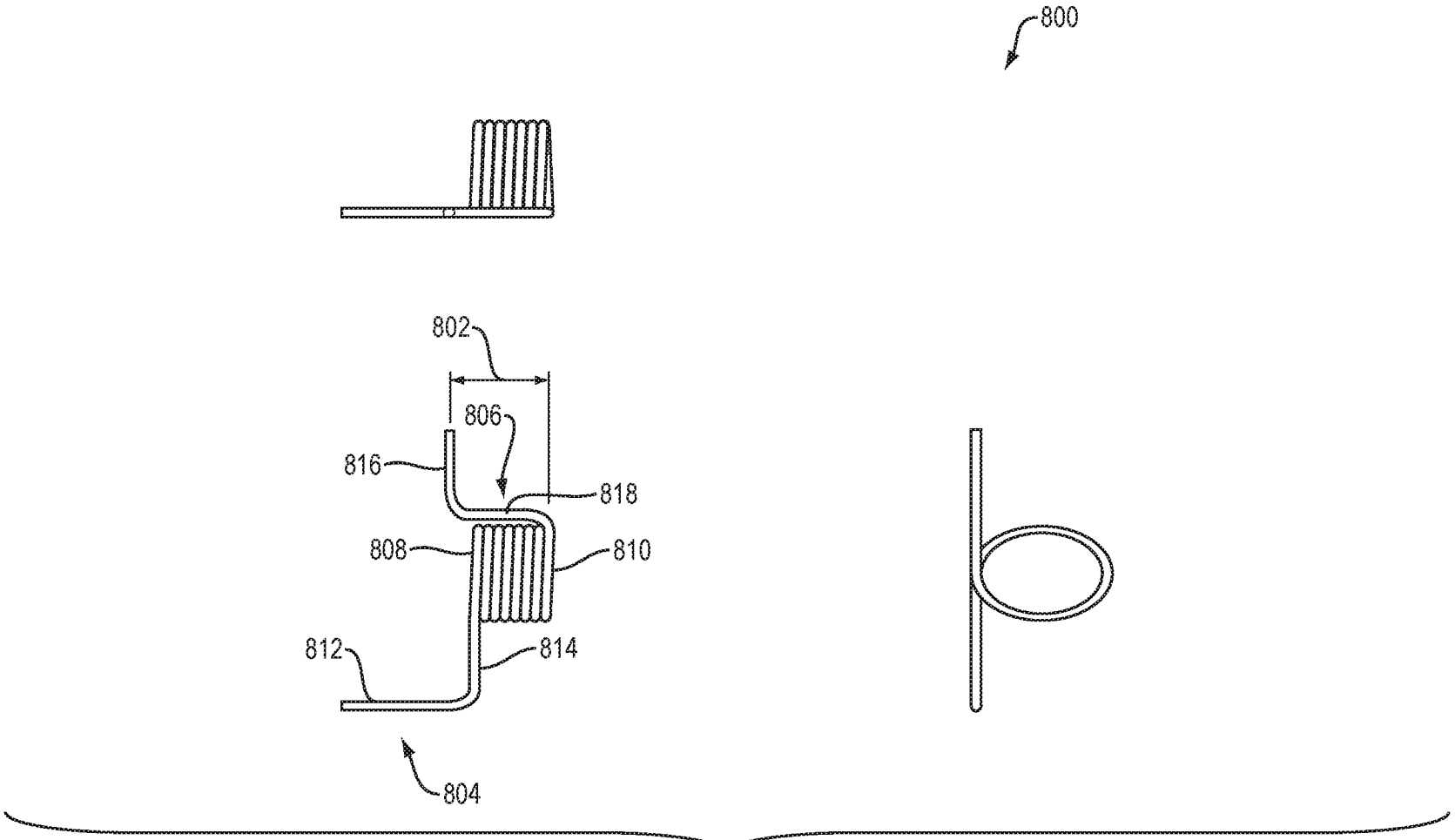
FIG. 8 shows multiple dimensioned views of an embodiment of a spring used in a spring-loaded system comprised in a connector wrench.

FIG. 8 shows multiple dimensioned views of an embodiment of a spring 800 used in a spring-loaded system comprised in the connector wrench. The spring is used to provide tension or force to push the movable jaw towards the fixed jaw. In some embodiments, the depth 802 of the spring 800 may range from about 3/32" to about 9/32". The spring 800 may also comprise a first arm 804 and a second arm 806 which act to apply a force to the spring 800 when it is used in a spring-loaded system comprised in a connector wrench. The first arm 804 may extend from a first end 808 of the spring 800, while the second arm 806 may extend from a second end 810 of the spring 800. The first arm 804 and the second arm 806 may each be bent to 90° angles, creating first sections 812 and 816 and second sections 814 and 818 of the first and second arms 804 and 806, respectively. The length of the first section 812 of the first arm 804 may range from about 5/32" to about 1/2". The length of first section 816 of the second arm 806 may similarly range from about 5/32" to about 1/2". The length of the second section 814 of the first arm 804 may range from 5/16" to about 7/16". The length of the second section 818 of the second arm 806 may range from about 1/8" to about 1/4".

Some notable distinctions from the conventional tools are the dimensions of the jaws. In the conventional designs such as the basin wrench, the movable jaw and fixed jaw are thicker and designed for higher torque for loosening or tightening plumbing attachments with threaded nuts from 3/8 hex to as large as 1.0 hex. These plumbing fixtures tend to require extreme torque to loosen due to corrosion and age. In contrast, the present tool is designed for a different application and designed for relatively low torque associated with connectors and sizes 0.5 diameter or hex to greater than 2 inch round or hex. The present tool has thinner dimensions that allow it to be placed on limited access regions such as panels for electrical and cooling connectors with cables extending from the connectors. A further feature is the use of a different material such as a plastic sleeve that allows for gripping and/or prevents marring of the connectors. A further feature relates to the shaft and engagement with the fixed jaw. Another aspect is the use of the tool outside the conventional realm of plumbing. Yet a further feature is the use of standard mating interfaces for engaging the fixed jaw as well as engaging the shaft. For example a standard drive socket wrench extension can be used to engage the fixed jaw and a standard socket wrench can engage the shaft.

The cable connector wrench in one example has a shaft with a pair of asymmetrical jaws at one end and in one example has a handle coupled to the other end. The two jaws form an assembly in which the jaws are joined with a pivot mechanism. The fixed jaw is attachable to the shaft and the movable jaw is coupled to the fixed jaw. The movable jaw is curved and spring-loaded so that it automatically closes to grip the connector. In a further embodiment, the fixed jaw is attached to the shaft with a pivot pin so that the entire fixed jaw and movable jaw assembly can rotate about an axis perpendicular to the shaft allowing the jaws to be rotated over the end of the shaft so that they can be "flipped" over, to allow the tool to be used to either tighten or loosen a connector. In a further embodiment, stops limit this rotation to about 180° so that when the jaws assembly is resting at a stop, the jaws will be perpendicular to the shaft and thus aligned to the connector. To provide connector rotation in severely restricted spaces, the connector wrench will rotate the connector through the space available and then slip in opposite direction to again regrip the connector for desired rotation direction through space available, repeat till desired rotation is achieved. This tool is adaptable to any cable connectors such as cabled and bayonet coupled connectors.

An additional feature is having a torque feature such as a slip gears and torque limiting units that can be integrated with the fixed jaw, the shaft, shaft extensions, or the handle. In one example, a torque limiting socket wrench can engage the fixed jaw or shaft and have a pre-set or adjustable torque setting. Once the sufficient amount of torque is applied, the torque limiter prevents over-tightening. Such over-tightening can damage electrical conductors or pins that thereby requiring increased maintenance. In a further example, a torque limiter is integrated or insertable into the fixed jaw providing torque limits.

In one example the tool is a kit having the shaft, the gripping section, and a handle portion. The shaft can come in multiple sizes, sections, or be telescoping. In one example the sections can be coupled to extend the length such as be threaded assembly. There can be several gripping sections for different sized and style of connectors as well as for difficult access regions. In one example there is mid portion, which may contain a torque limiter that is configured to receive the shaft on one end and the handle section on the opposing end.

In operations according to one example, an operator sent to service an electrical module with multiple connectors and cable assemblies would determine which of the cabled connectors was presenting issues. If the issue was an intermittent or low level signal, the connector could just require tightening. The operator would place the fixed and movable jaws in the proper direction for tightening and maneuver the fixed and movable jaws between and around the other cables and connectors to the proper connector. Once in proximity of the connector, the tool can be manipulated around the connector wherein the spring tension is enough to open the jaws when pushed around the connector but sufficient to provide initial engagement with the connector and hold it in place while the shaft is turned clockwise for tightening. If there is a torque limiter, the tool will only provide a certain amount of force or a measurable amount of force. If there is no torque limiter, the operator will apply sufficient force to tighten the connector. If the operator is required to move the cabled connector, the operator would place the fixed and movable jaws in the correct orientation to untighten the connector and maneuver the tool proximate the connector and engage the connector such that the movable and fixed go around at least a portion of the connector. Once in place, the spring force of the tool is configured to engage the connector.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

What is claimed is:

1. A connector wrench for use on electrical connectors, comprising:

a movable jaw;

a fixed jaw coupled with the movable jaw, wherein the movable jaw and the fixed jaw cooperate to engage a connector of a cabled assembly;

a shaft coupled with the fixed jaw on a first end;

a sleeve affixed to cover at least a portion of the movable jaw that engages the connector; and a torque limiter integrated with the shaft or the fixed jaw and configured to allow for a low torque to be applied to the connector, wherein the torque limiter is a slip gear;

wherein the connector wrench is adapted for tightening or loosening the connector of the cabled assembly.

2. The connector wrench of claim 1, wherein the connector wrench is configured to apply the low torque of less than 90 in-lbs.

3. The connector wrench of claim 1, wherein the connector wrench is configured to apply the low torque ranging from 2 to 45 in-lbs.

4. The connector wrench of claim 1, further comprising a fastener connecting the movable jaw and the fixed jaw.

5. The connector wrench of claim 4, wherein the fastener comprises a spring-loaded mechanism on the movable jaw to apply a spring force between the fixed jaw and the movable jaw.

6. The connector wrench of claim 1, wherein the fixed jaw comprises at least one shaft interface for coupling the shaft to the fixed jaw.

7. The connector wrench of claim 1, wherein the movable jaw has a thickness ranging from 0.060 to 0.20 inches.

8. The connector wrench of claim 1, wherein the movable jaw has a thickness ranging from 0.075 to 0.15 inches.

9. The connector wrench of claim 1, further comprising a pivot mechanism connecting the shaft to the fixed jaw, wherein the pivot mechanism allows the fixed jaw to pivot at least about 180 degrees in one direction and change an engaging direction.

10. The connector wrench of claim 1, further comprising a mating connector on an opposing end of the shaft.

11. The connector wrench of claim 10, further comprising an attachment coupled to the mating connector.

12. The connector wrench of claim 1, wherein at least one of the movable jaw and the fixed jaw comprises at least some portion with a plurality of teeth.

13. A method of coupling cables to a panel, comprising:

providing a plurality of cables connectable to the panel, where the cables have a cable connector engaging with mating receptacle on the panel;

providing a connector wrench comprising:

a movable jaw;

a fixed jaw coupled to the movable jaw wherein the movable jaw pivots with respect to the fixed jaw;

a shaft connected to the fixed jaw;

a sleeve covering at least a portion of the movable jaw that engages the connector;

a torque limiter integrated into fixed jaw and configured to limit a torsional force; and arranging the movable jaw to engage the cable connector; and applying the torsional force to the shaft, wherein the torsional force rotates the cable connector with respect to the mating receptacle.

14. The method of claim 13, wherein applying the torsional force loosens or tightens the cable connector.

15. The method of claim 13, wherein the connector wrench applies the torsional force of less than 90 in-lbs.

16. A kit for assembling a connector wrench, comprising:

at least one gripping element comprising a movable jaw coupled to a fixed jaw and having a receptacle;

a sleeve permanently covering at least a portion of the movable jaw;

a shaft configured to mate with the receptacle on a first end of the shaft;

a torque limiter configured to prevent overtightening and limit torsional force, wherein the torque limiter is a slip gear; and a handle configured to mate with a receptacle on a second end of the shaft wherein the connector wrench is configured to engage with a cable connector.

* * * * *